US009132626B2

(12) United States Patent
Mizes et al.

(10) Patent No.: US 9,132,626 B2
(45) Date of Patent: Sep. 15, 2015

(54) SYSTEM AND METHOD FOR MEASURING CROSS-TALK IN INKJET PRINTHEADS

(71) Applicant: Xerox Corporation, Norwalk, CT (US)

(72) Inventors: Howard A. Mizes, Pittsford, NY (US); Daniel S. Hann, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/163,880

(22) Filed: Jan. 24, 2014

(65) Prior Publication Data

US 2015/0210068 A1 Jul. 30, 2015

(51) Int. Cl.
*B41J 29/38* (2006.01)
*B41J 29/393* (2006.01)
*B41J 2/045* (2006.01)

(52) U.S. Cl.
CPC ..... *B41J 2/04505* (2013.01)

(58) Field of Classification Search
CPC ..... B41J 29/393; B41J 2/2135; B41J 11/46; B41J 2/04505
USPC ..... 347/14, 16, 19
See application file for complete search history.

(56) References Cited

U.S. PATENT DOCUMENTS

| | | | | |
|---|---|---|---|---|
| 6,026,258 | A | 2/2000 | Fresk et al. | |
| 7,794,040 | B2 | 9/2010 | Snyder | |
| 8,046,617 | B2 | 10/2011 | Fleck et al. | |
| 8,228,520 | B2 | 7/2012 | Snyder | |
| 8,456,669 | B2 | 6/2013 | Bisset | |
| 2002/0181986 | A1 * | 12/2002 | Castano et al. | 400/74 |
| 2014/0313256 | A1 * | 10/2014 | Donaldson et al. | 347/19 |

* cited by examiner

*Primary Examiner* — Jannelle M Lebron
(74) *Attorney, Agent, or Firm* — Maginot Moore & Beck LLP

(57) ABSTRACT

An inkjet printer forms low and high area coverage test patterns using inkjets in a printhead. The printer identifies process direction offsets for the inkjets in both test patterns using scanned image data of the printed test patterns. The printer identifies a level of cross-talk in the printhead with reference to a standard deviation difference between the process direction offsets identified in the low area coverage and high area coverage test patterns. The printer generates a recommendation for an operational configuration of the printhead based on the identified level of cross-talk.

20 Claims, 7 Drawing Sheets

SYSTEM AND METHOD FOR MEASURING CROSS-TALK IN INKJET PRINTHEADS

TECHNICAL FIELD

The system and method disclosed in this document relates to inkjet printing systems generally, and, more particularly, to systems and methods for identifying interactions between inkjets in a printhead.

BACKGROUND

Inkjet printers have printheads configured with a plurality of inkjets that eject liquid ink onto an image receiving member. The ink may be stored in reservoirs located within cartridges installed in the printer. Such ink may be aqueous, oil, solvent-based, or UV curable ink or an ink emulsion. Other inkjet printers receive ink in a solid form and then melt the solid ink to generate liquid ink for ejection onto the imaging member. In these solid ink printers, the solid ink may be in the form of pellets, ink sticks, granules, pastilles, or other shapes. The solid ink pellets or ink sticks are typically placed in an ink loader and delivered through a feed chute or channel to a melting device that melts the ink. The melted ink is then collected in a reservoir and supplied to one or more printheads through a conduit or the like. In other inkjet printers, ink may be supplied in a gel form. The gel is also heated to a predetermined temperature to alter the viscosity of the ink so the ink is suitable for ejection by a printhead.

Many inkjet printhead configurations include multiple inkjets that are formed in an array and are fluidly coupled to a single ink reservoir that supplies liquid ink to the inkjets. Each inkjet includes an actuator that ejects an ink drop from a pressure chamber in response to an electrical firing signal. During operation, multiple inkjets in a printhead often experience "cross-talk" where the operation of one inkjet is affected by the operations of other inkjets in the printhead during a printing operation. Sources of cross-talk include electrical cross-talk due to leakage of the electrical firing signal between the actuators for multiple inkjets, mechanical coupling between layers of the printhead that extend between multiple inkjets, such as a diaphragm layer that is coupled to the actuator in each inkjet, and fluidic pressure coupling that occurs when an inkjet ejects an ink drop and ink flows through shared ink conduits to refill the inkjet pressure chamber. As used herein, a reference to measuring or identifying "cross-talk" refers to measurement of variations in process direction placement of ink drops from inkjets in a printhead that are produced due to the effects of cross-talk. The measurement of cross-talk can be for individual inkjets or as an aggregate measurement for a printhead with multiple inkjets.

Excessive cross-talk in a printhead produces a significant change in the velocities of ink drops that are ejected from a given inkjet in the printhead during a printing operation compared to the velocity that drop would have if no other jets were firing. The effects of cross-talk are mostly perceptible near the edges of high-density printed images. For example, a solid printed line may appear to have an uneven edge because an alignment of the timing of the firing of the inkjets is typically performed in the absence of crosstalk. When a printhead experiences crosstalk, the process direction position of the drops change and thus produce the uneven edge. While numerous manufacturing and operating techniques that reduce printhead cross-talk are known to the art, some degree of cross-talk is often inherent to a printhead. The level of cross-talk between different printheads often varies due to variations in manufacturing of each printhead. Printheads with low levels of crosstalk would be desired for applications that require the highest quality printing. Consequently, improved methods for identifying levels of cross-talk in individual printheads to enable a printer to form high-quality images based on the cross-talk level for each printhead would be beneficial.

SUMMARY

In one embodiment an inkjet printer that identifies cross-talk in a printhead has been developed. The printer includes a printhead including a plurality of inkjets configured to eject ink drops onto an image receiving surface to form an ink image, an optical scanner configured to generate scanned image data of the ink image on the image receiving surface, and a controller operatively connected to the printhead and the optical scanner. The controller is configured to operate the printhead to eject a first plurality of ink drops from the plurality of inkjets to form a first test pattern on the image receiving surface, the first test pattern having a first area coverage, generate first scanned image data of the first test pattern with the optical scanner, identify a first plurality of process direction offsets for the plurality of inkjets with reference to the first scanned image data, operate the printhead to eject a second plurality of ink drops from the plurality of inkjets to form a second test pattern on the image receiving surface, the second test pattern having a second area coverage, the second area coverage being greater than the first area coverage, generate second scanned image data of the second test pattern with the optical scanner, identify a second plurality of process direction offsets for the plurality of inkjets with reference to the second scanned image data, identify a level of cross-talk in the printhead with reference to a difference between the first plurality of process direction offsets and the second plurality of process direction offsets, and store the identified level of cross-talk in a memory in association with the printhead to generate a recommendation for an operational configuration of the printhead during operation of the printer.

In another embodiment a method of operating an inkjet printer to identify cross-talk in a printhead has been developed. The method includes operating with a controller a printhead to eject a first plurality of ink drops from a plurality of inkjets in the printhead to form a first test pattern on an image receiving surface, the first test pattern having a first area coverage, generating with an optical scanner first scanned image data of the first test pattern, identifying with the controller a first plurality of process direction offsets for the plurality of inkjets with reference to the first scanned image data, operating with the controller the printhead to eject a second plurality of ink drops from the plurality of inkjets to form a second test pattern on the image receiving surface, the second test pattern having a second area coverage, the second area coverage being greater than the first area coverage, generating with the optical scanner second scanned image data of the second test pattern with the optical scanner, identifying with the controller a second plurality of process direction offsets for the plurality of inkjets with reference to the second scanned image data, identifying with the controller a level of cross-talk in the printhead with reference to a difference between the first plurality of process direction offsets and the second plurality of process direction offsets, and storing with the controller the identified level of cross-talk in a memory in association with the printhead to generate a recommendation for an operational configuration of the printhead during operation of the printer.

DETAILED DESCRIPTION

Figure 1:
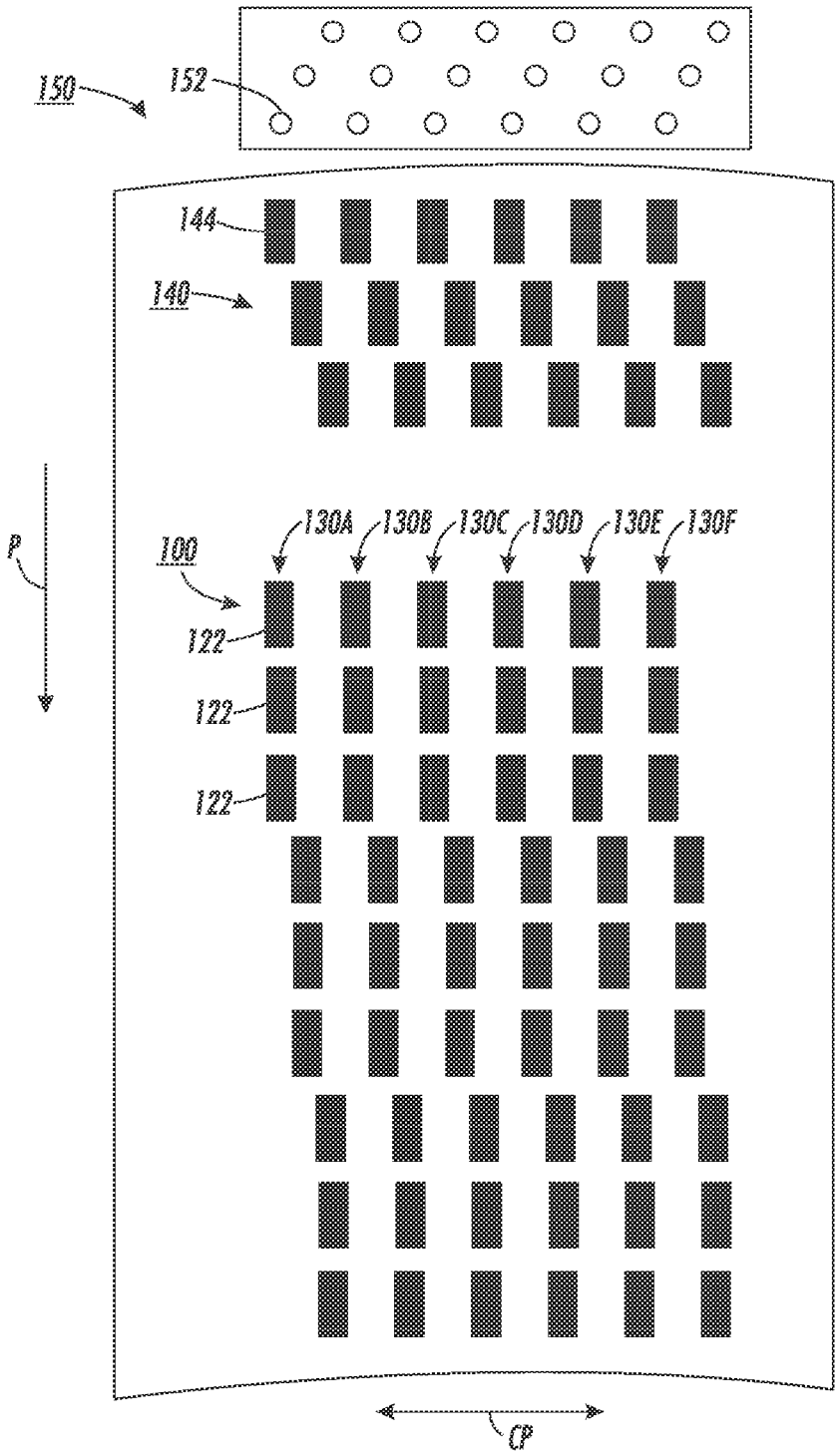
FIG. 1 is a diagram of a low area coverage printed test pattern that produces minimal cross-talk in an inkjet printhead.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images with colorants on media, such as digital copiers, bookmaking machines, facsimile machines, multi-function machines, and the like. As used herein, the term "process direction" refers to a direction of movement of an image receiving surface, such as a continuous media web pulled from a roll of paper or other suitable print medium along a media path through a printer. A media transport in the printer uses one or more actuators, such as electric motors, to move the print medium past one or more printheads in the print zone to receive ink images and passes other printer components, such as heaters, fusers, pressure rollers, and on-sheet optical imaging sensors, that are arranged along the media path. As used herein, the term "cross-process" direction refers to an axis that is perpendicular to the process direction along the surface of the print medium.

As used herein, the term "area coverage" refers to the ratio of a printed region of an image receiving surface that is covered with ink in a printed image from a single printhead to the maximum amount of ink that single printhead could deliver to the image receiving surface. For example, consider a printed test pattern of ink drops from an inkjet printhead that covers a rectangular region of an image receiving surface with a predetermined length and width, where the length defines the extent of the test pattern in the process direction and the width defines the extent of the test pattern in the cross process direction. The maximum number of drops that could be deposited in this rectangular area is the product of the time it takes the length of the test pattern area to pass under a nozzle, the jetting frequency, and the number of jets on the printhead. The area coverage refers to the ratio of the actual number of drops deposited to the maximum number of drops deposited. The area coverage is often expressed as a percentage from 0% with no ink covering the image receiving surface to 100% where the maximum proportion of the image receiving surface is covered with ink for a given printhead configuration. Many types of images require an inkjet printhead to substantially print at an area coverage near or at the maximum 100% area coverage over significant regions. In an inkjet printer, a digital controller generates electrical firing signals that control the operation of inkjets in a printhead to print images with different area coverages.

As used herein, the term "offset" refers to a spatial distance between a location of a printed mark formed from one or more ink drops on an image receiving surface and another location on the image receiving surface. A "process direction offset" refers to a spatial distance between the printed mark and another location on the image receiving surface in the process direction. In some instances, the offset distance corresponds to a registration error between the measured location of the printed mark and the expected location of the printed mark on the image receiving surface. The expected location may be a location relative to the process direction locations of other printed marks or to a predetermined fiducial mark that is formed on the image receiving surface.

As used herein, the term "average" refers to any computed value produced from two or more input numeric values that has an effect of summarizing the plurality of input data values. The standard arithmetic mean of a plurality of numbers is one non-limiting example of an average, but other values including, but not limited to, the geometric mean, harmonic mean, weighted mean, and median, are also averages. As used herein, the term "standard deviation" refers to any value or number related to a distribution of numeric values relative to an average of the numeric values. The standard deviation is defined broadly and includes, but is not limited to, an arithmetic standard deviation, geometric standard deviation, variance, or statistical distribution of the values relative to the average.

Figure 6:
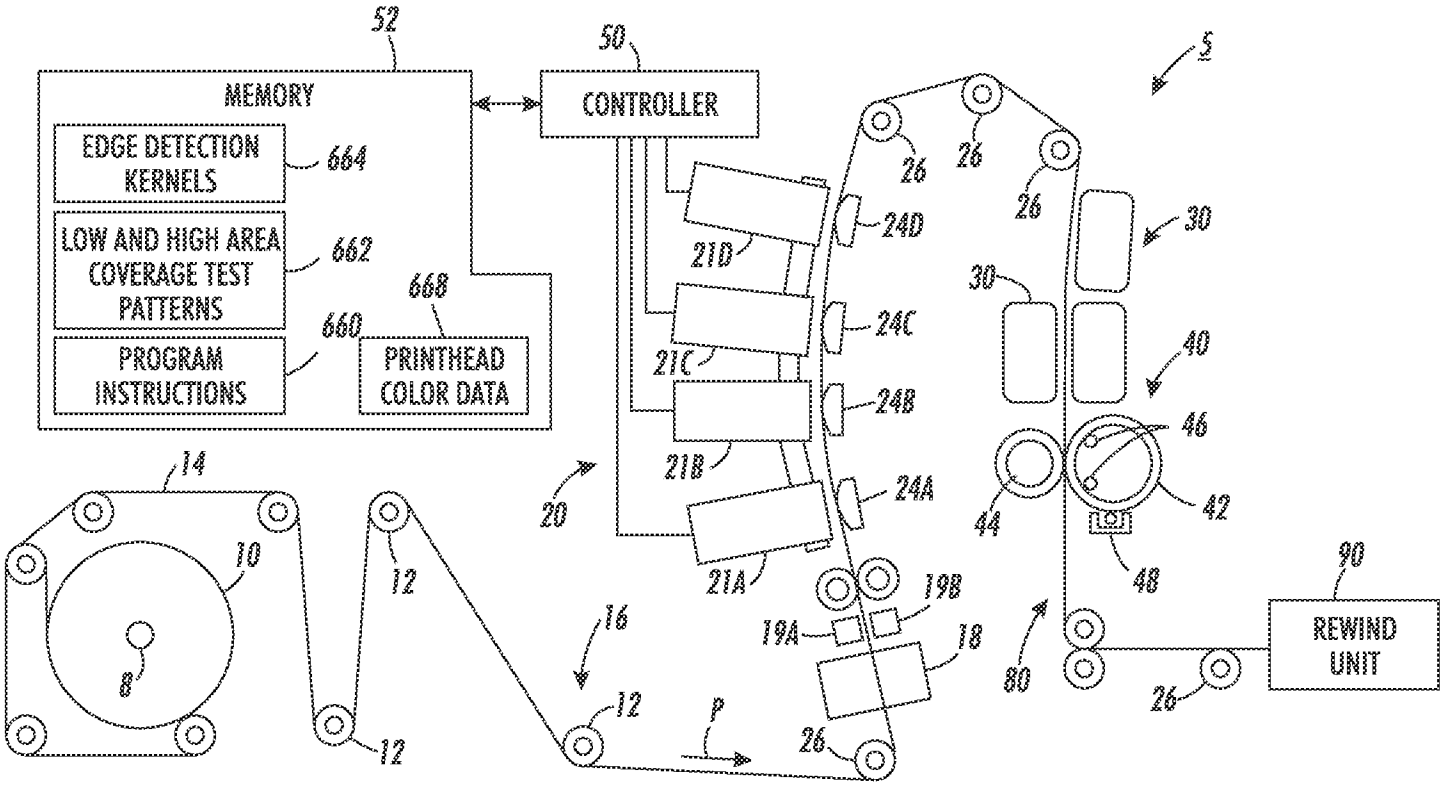
FIG. 6 is a schematic diagram of a continuous web inkjet printer that is configured to identify cross-talk in a plurality of printheads that are arranged in a print zone.

FIG. 6 depicts an inkjet printer 5. For the purposes of this disclosure, an inkjet printer employs one or more inkjet printheads to eject drops of ink into an image receiving member, such as paper, another print medium, or an indirect member such as a rotating image drum or belt. The printer 5 is configured to print ink images with a "phase-change ink," by which is meant an ink that is substantially solid at room temperature and that transitions to a liquid state when heated to a phase change ink melting temperature for jetting onto the imaging receiving member surface. The phase change ink melting temperature is any temperature that is capable of melting solid phase change ink into liquid or molten form. In one embodiment, the phase change ink melting temperature is approximately 70° C. to 140° C. In alternative embodiments, the ink utilized in the printer comprises UV curable gel ink. Gel inks are also heated before being ejected by the inkjet ejectors of the printhead. As used herein, liquid ink refers to melted phase change ink, heated gel ink, or other forms of ink, such as aqueous inks, ink emulsions, ink suspensions, ink solutions, or the like.

The printer 5 includes a controller 50 to process the image data before generating the control signals for the inkjet ejectors to eject colorants. Colorants can be ink, or any suitable substance that includes one or more dyes or pigments and that is applied to the selected media. The colorant can be black or any other desired color, and some printer configurations apply a plurality of distinct colorants to the media. In the configuration of FIG. 6, the printer 5 ejects cyan, magenta, yellow, and black (CMYK) inks onto the media web to form color ink images. The media includes any of a variety of substrates, including plain paper, coated paper, glossy paper, or transparencies, among others, and the media can be available in sheets, rolls, or other physical formats.

The printer 5 is an example of a direct-to-sheet, continuous-media, phase-change inkjet printer that includes a media supply and handling system configured to supply a long (i.e., substantially continuous) web of media 14 of "substrate" (paper, plastic, or other printable material) from a media source, such as spool of media 10 mounted on a web roller 8. For simplex printing, the printer 5 passes the media web 14 through a media conditioner 16, print zone 20, and rewind unit 90 once. In the simplex operation, the media source 10 has a width that substantially covers the width of the rollers over which the media travels through the printer.

The media web 14 is unwound from the source 10 as needed and a variety of motors, not shown, rotate one or more rollers 12 and 26 to propel the media web 14. The media conditioner includes rollers 12 and a pre-heater 18. The rollers 12 and 26 control the tension of the unwinding media as the media moves along a path through the printer. In alternative embodiments, the printer transports a cut sheet media through the print zone in which case the media supply and handling system includes any suitable device or structure to enable the transport of cut media sheets along a desired path through the printer. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media is transported through a print zone 20 that includes a series of color printhead modules 21A, 21B, 21C, and 21D, each printhead unit effectively extends across the width of the media and is able to eject ink directly (i.e., without use of an intermediate or offset member) onto the moving media. In printer 5, each of the printheads ejects a single color of ink, one for each of the colors typically used in color printing, namely, cyan, magenta, yellow, and black (CMYK) for printhead modules 21A, 21B, 21C, and 21D, respectively. The controller 50 of the printer receives velocity data from encoders mounted proximately to rollers positioned on either side of the portion of the path opposite the four printheads to calculate the linear velocity and position of the web as the web moves past the printheads. The controller 50 uses these data to generate firing signals for actuating the inkjet ejectors in the printheads to enable the printheads to eject four colors of ink with appropriate timing and accuracy for registration of the differently colored patterns to form color images on the media. The inkjet ejectors actuated by the firing signals correspond to digital data processed by the controller 50. The digital data for the images to be printed can be transmitted to the printer, generated by a scanner (not shown) that is a component of the printer, or otherwise generated and delivered to the printer. In various configurations, a printhead module for each primary color includes one or more printheads; multiple printheads in a module are formed into a single row or multiple row array; printheads of a multiple row array are staggered; a printhead prints more than one color; or the printheads or portions thereof are mounted movably in a direction transverse to the process direction P for printing operations, such as for spot-color applications and the like. While the printhead modules in the printer 5 are configured to eject liquid drops of a phase change ink onto the media web 14, a similar configuration of inkjets that print solvent inks, aqueous inks, or any other liquid ink can be used to generate color ink images as described herein.

Associated with each printhead module is a backing member 24A-24D, typically in the form of a bar or roll, which is arranged substantially opposite the printhead on the back side of the media. Each backing member positions the media at a predetermined distance from the printhead opposite the backing member. The backing members 24A-24D are optionally configured to emit thermal energy to heat the media to a predetermined temperature, which is in a range of about 40° C. to about 60° C. in printer 5. The various backer members can be controlled individually or collectively. The pre-heater 18, the printheads, backing members 24A-24D (if heated), as well as the surrounding air combine to maintain the media along the portion of the path opposite the print zone 20 in a predetermined temperature range of about 40° C. to 70° C.

As the partially-imaged media web 14 moves to receive inks of various colors from the printheads of the print zone 20, the printer 5 maintains the temperature of the media web 14 within a given range. The printheads in the printhead modules 21A-21D eject ink at a temperature typically significantly higher than the temperature of the media web 14. Consequently, the ink heats the media, and temperature control devices can maintain the media web temperature within a predetermined range. For example, the air temperature and air flow rate behind and in front of the media web 14 impacts the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable regulation of the media temperature.

Following the print zone 20 along the media path are one or more "mid-heaters" 30. A mid-heater 30 can use contact, radiant, conductive, and/or convective heat to control a temperature of the media. The mid-heater 30 brings the ink placed on the media to a temperature suitable for desired properties when the ink on the media is sent through the fixing assembly 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader in the fixing assembly 40.

Following the mid-heaters 30, a fixing assembly 40 applies heat and/or pressure to the media to fix the images to the media. The fixing assembly includes any suitable device or apparatus for fixing images to the media including heated or unheated pressure rollers, radiant heaters, heat lamps, and the like. In the embodiment of the FIG. 6, the fixing assembly 40 includes a "spreader", that applies a predetermined pressure, and in some implementations, heat, to the media. The function of the spreader in the fixing assembly 40 is to flatten the individual ink droplets, strings of ink droplets, or lines of ink on web 14 and flatten the ink with pressure and, in some systems, heat. The spreader flattens the ink drops to fill spaces between adjacent drops and form uniform images on the media web 14. In addition to spreading the ink, the fixing assembly 40 improves fixation of the ink image to the media web 14 by increasing ink layer cohesion and/or increasing the ink-web adhesion. The spreader includes rollers, such as image-side roller 42 and pressure roller 44, to apply heat and pressure to the media. Either roller can include heat elements, such as heating elements 46, to bring the web 14 to a temperature in a range from about 35° C. to about 80° C. In alternative embodiments, the fixing assembly spreads the ink using non-contact heating (without pressure) of the media after the print zone 20. Such a non-contact fixing assembly can use any suitable type of heater to heat the media to a desired temperature, such as a radiant heater, UV heating lamps, and the like.

In one practical embodiment, the roller temperature in the fixing assembly 40 is maintained at an optimum temperature that depends on the properties of the ink, such as 55° C. Generally, a lower roller temperature gives less line spread while a higher temperature produces imperfections in the gloss of the ink image. Roller temperatures that are too high may cause ink to offset to the roll. In one practical embodiment, the nip pressure is set in a range of about 500 to about 2000 psi lbs./side. Lower nip pressure produces less line spread while higher pressure may reduce pressure roller life.

The fixing assembly 40 can include a cleaning/oiling station 48 associated with image-side roller 42. The station 48 cleans and/or applies a layer of some release agent or other material to the roller surface. The release agent material can be an amino silicone oil having viscosity of about 10-200 centipoises. A small amount of oil transfers from the station to the media web 14, with the printer 5 transferring approximately 1-10 mg per A4 sheet-sized portion of the media web 14. In one embodiment, the mid-heater 30 and fixing assembly 40 are combined into a single unit, with their respective functions occurring relative to the same portion of media simultaneously. In another embodiment the media is maintained at a high temperature as the media exits the print zone 20 to enable spreading of the ink.

Following passage through the fixing assembly 40 the printed media can be wound onto a roller in the rewind unit 90 for removal from the system. Alternatively, the media can be directed to other processing stations that perform tasks such as cutting, binding, collating, and/or stapling the media or the like.

In printer 5, a controller 50 is operatively connected to various subsystems and components to regulate and control operation of the printer 5. The controller 50 is implemented with general or specialized programmable processors that execute programmed instructions. A memory 52 stores programmed instructions 660, predetermined image data 662 that correspond to low area coverage and high area coverage test patterns, data corresponding to an edge detection kernel 664, and data corresponding to recommended ink colors for each printhead 668 that are generated based on the level of cross-talk in each printhead. As described below, the controller 50 operates the printheads in the printhead modules 21A-21D to form printed patterns corresponding to the low area coverage and high area coverage image data 662. The controller 50 identifies the process direction locations of the printed marks using the edge detection kernels 664 and identifies the level of cross-talk for each printhead based on the difference of the process directions offsets between low and high area coverage patterns.

The printer 5 includes an optional output device 56 that is operatively connected to the controller 50. The output device 56 is, for example, a visual display device or a network device that transmits data through a data network to another computing device (not shown). In one mode of operation, the controller 50 generates an output for printhead color recommendations based on the identified level of cross-talk in each printhead. For example, if a printhead has a low level of cross-talk, the output device 56 generates an output that identifies the printhead in the print zone 20 and recommends that the printhead be operationally connected to the black ink printhead module 21D. If a printhead has a high level of cross-talk, the output device 56 generates another output that recommends a different ink color, such as the yellow ink printhead module 21C.

The processors, their memories, and interface circuitry configure the controllers and/or print engine to perform the printer operations. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits. The controller 50 is operatively connected to the print bar and printhead motors of printhead modules 21A-21D in order to generate electrical firing signals for operation of the inkjets to form ink images on the media web 14.

The printer 5 includes an optical sensor 54 that is configured in a manner similar to that described above for the imaging of the printed web. The optical sensor is configured to detect, for example, the presence, reflectance values, and/or location of ink drops jetted onto the receiving member by the inkjets of the printhead assembly. The optical sensor 54 includes an array of optical detectors mounted to a bar or other longitudinal structure that extends across the width of an imaging area on the image receiving member. The optical sensor 54 generates a series of image data scanlines where each scanline includes an array of pixels that extend in the cross-process direction across the media web 14. As the media web 14 moves in the process direction, the optical sensor 54 generates a series of scanlines that form a two-dimensional array of image data. The controller 50 processes the image data corresponding to different printed test patterns to identify printhead cross-talk in the printhead modules 21A-21D.

Figure 2:
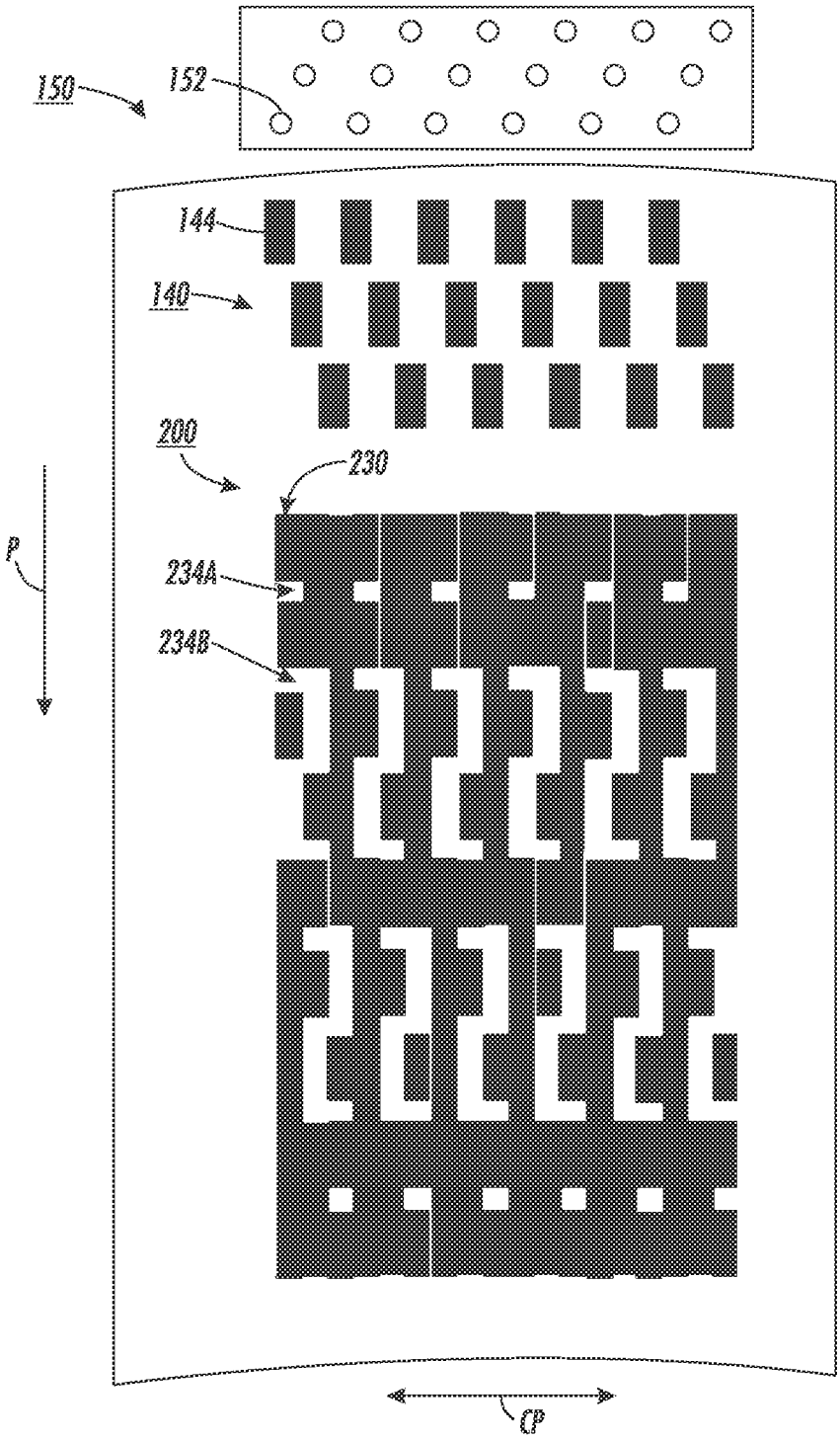
FIG. 2 is a diagram of a high area coverage printed test pattern that produces an elevated level of cross-talk in an inkjet printhead.

FIG. 1 and FIG. 2 depict simplified examples of a low area coverage printed test pattern 100 and a high area coverage printed test pattern 200, respectively. In FIG. 1 and FIG. 2, a printhead 150 is a simplified depiction of one printhead in the printer 5. Each of the inkjets in the printhead 150, such as the inkjet 152, ejects ink drops to form printed marks in the test pattern. FIG. 1 and FIG. 2 also depict fiducial marks 140 that are used to identify the cross-process direction locations of the inkjets prior to identification of the process direction locations of the printed marks in the test patterns. The test pattern 100 is a low area coverage test pattern where the controller 50 measures the location of each printed mark to identify a process direction offset for each inkjet in the printhead 150. The test pattern 200 includes the same printed pattern of marks as the test pattern 100, but the remaining inkjets in the printhead 150 are operated concurrently with the inkjets that form each set of printed marks to increase the overall area coverage of the printed test pattern 200. As described below, the low area coverage test patterns produce minimal cross-talk in the printhead while high area coverage test patterns produce elevated levels of cross-talk. The controller 50 characterizes an inherent level of cross-talk in a printhead based on the differences in process direction offset between the low and high area coverage test patterns.

Figure 3:
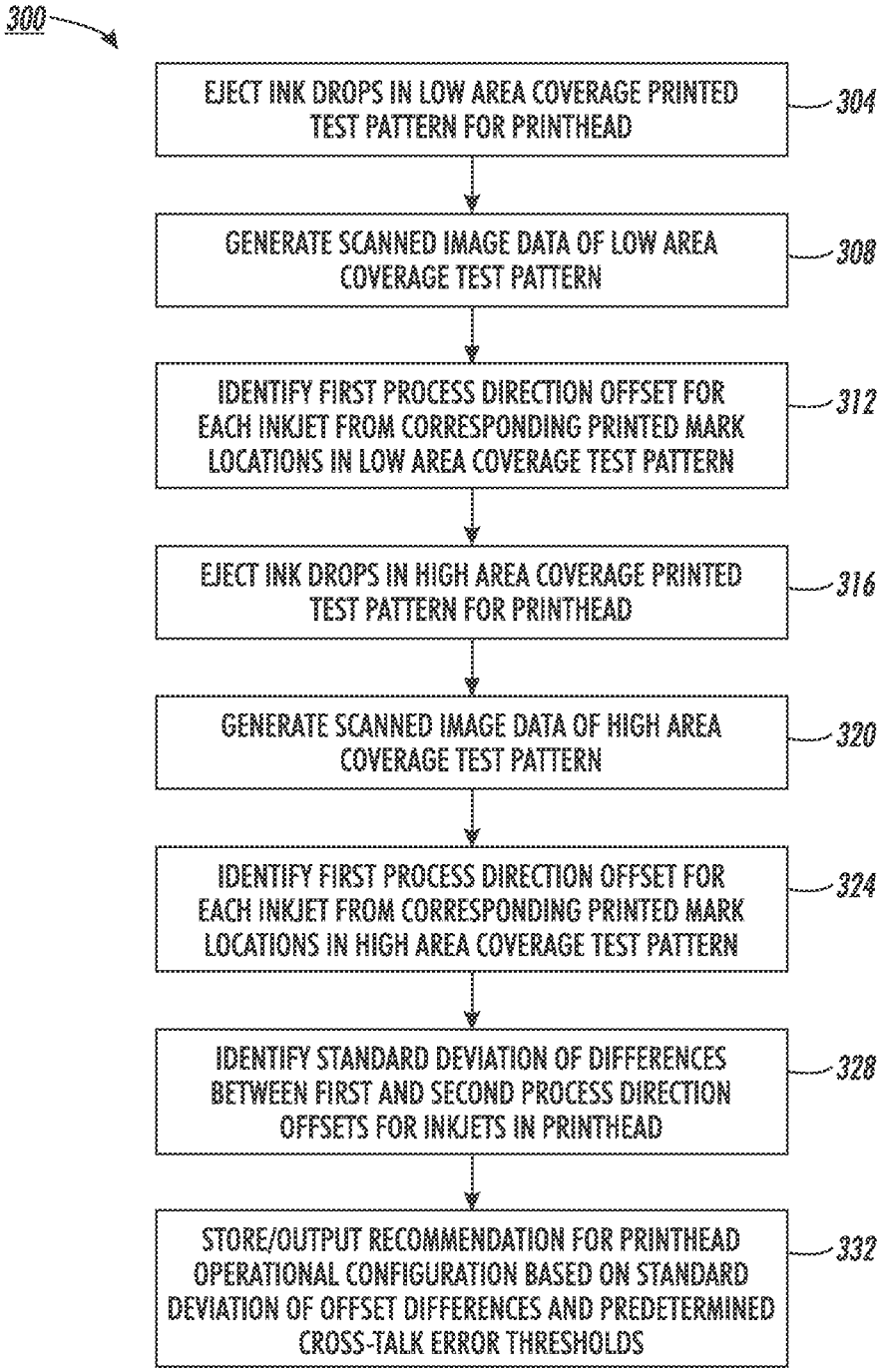
FIG. 3 is a block diagram of a process for identifying cross-talk in an inkjet printhead.

FIG. 3 depicts a process 300 for the characterization of cross-talk in one or more printheads in a printer. In the description below, a reference to the process 300 performing an action or function refers to the execution of stored program instructions by a controller to perform the function or action in conjunction with one or more components in the printer. The process 300 is described in conjunction with a single printhead in a printer for illustrative purposes, but printers that include multiple printheads optionally perform process 300 for each printhead in the printer either individually or in groups of multiple printheads. Process 300 is described in conjunction with FIG. 1, FIG. 2, and FIG. 4-FIG. 6 for illustrative purposes.

Process 300 begins as the controller 50 operates one or more of the printheads in the print zone 20 to eject ink drops onto the media web 14 to form a low area coverage test pattern (block 304). The controller 50 retrieves the low area coverage test pattern data 662 from the memory 52 to control the operation of the printhead 150. The low area coverage test pattern includes printed marks from each of the inkjets in the printhead 150, but the controller 50 operates the printhead 150 with a comparatively small number of inkjets being activated concurrently to produce the test pattern 100. The inkjets that are operated concurrently are also separated from each other in the printhead 150, which tends to reduce the effects of cross-talk between the inkjets. For example, in the simplified embodiment of FIG. 1, the dash length is approximately three times the gap between adjacent dashes in the process direction. There are also two inkjets between two adjacent dashes in the cross process direction. Therefore, the area coverage is approximately $$\left(\frac{3}{4}\right)\left(\frac{1}{3}\right) = 25\%$$

to form the low area coverage printed test pattern 100. In another printhead embodiment that includes several hundred inkjets, the printed test pattern is formed by using every fifth inkjet in forming a row of FIG. 1. In this printhead embodiment, the dash length, the gap between the rows, and the print density of the dash is different ultimately giving an area coverage that is approximately 9%.

Process 300 continues as the printer 5 generates scanned image data of the low area coverage patter (block 308) and identifies the process direction offset for each of the inkjets that form the printed marks in the low area coverage test pattern (block 312). In the printer 5, the optical sensor 54 generates scanned image data corresponding to the low-density printed test pattern and printed marks corresponding to the fiducial pattern. In the example of FIG. 1, the fiducial pattern 140 includes a printed dash formed by each of the inkjets in the printhead 150. The controller 50 identifies the cross-process direction location of the inkjets along the cross-process direction axis CP from the locations of the corresponding printed marks in the fiducial pattern 140. The optical sensor 54 also generates scanned image data of the printed marks in the low area coverage test pattern 100. In one embodiment, the scanned image data have numeric values on a scale of 0 to 255 where lower values near 0 correspond to a pixel that includes at least a portion of an ink drop while values that are near 255 correspond to blank paper on the media web 14. The controller 50 generates weighted averages of a three or more columns of image data that extend in the process direction P centered on the expected locations of marks from each inkjet that are identified in the fiducial pattern 140. For example, the controller 50 generates a weighted average of three pixel columns for the inkjet 152 using the cross-process direction location of the fiducial 144 to identify the weighted average image values of the printed marks 120 in the process direction P.

Figure 4:
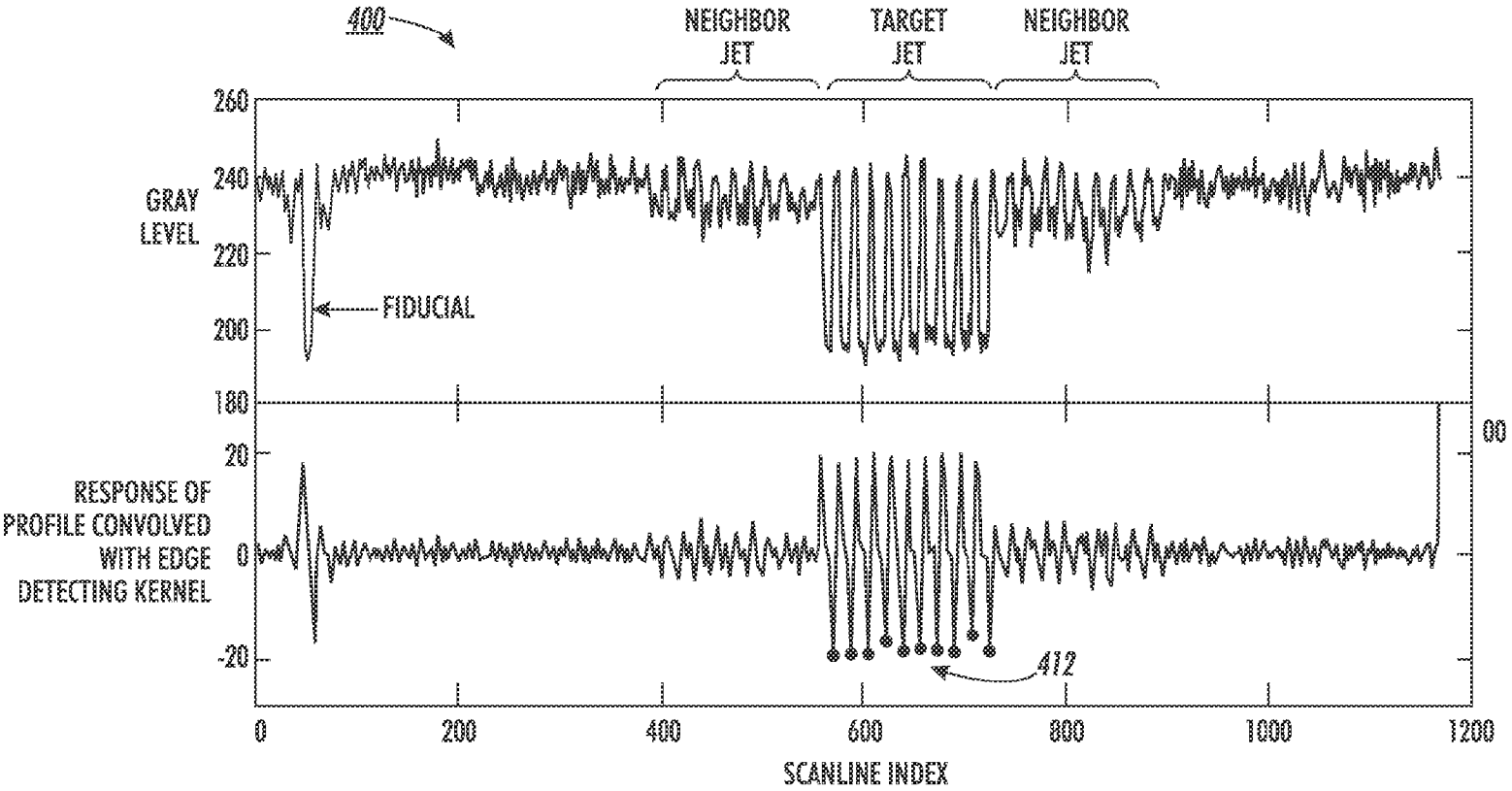
FIG. 4 is a graph that depicts image data and local minimum values that identify the process direction edges of one column of printed marks in a test pattern.

The controller 50 applies the edge detection kernel 664 from the memory 52 to identify an edge of each of the printed marks in the weighted average image data, such as the bottom edges 122 of the dashes in the column 120. In one embodiment, the controller 50 applies a convolution of the edge detection kernel to the column of weighted average image data and identifies the bottom edges of dashes as local minimum values from the convolution. FIG. 4 depicts a graph 400 of the image data and local minimum values 412 that identify the process direction edges of one column of printed marks in a test pattern embodiment that includes a series of ten printed marks for each inkjet. The controller 50 uses the edge detection kernel to identify the process direction edges of each printed mark. Using multiple printed marks for each inkjet in the test pattern reduces the effects of noise in the image data. The controller 50 identifies the process direction offset for each inkjet as a difference between the average process direction locations of the dash edges in the test pattern for each inkjet from an overall average process direction location for each group of dashes that are formed concurrently. For example in FIG. 1, the process direction offset for the inkjet 152 is the difference between the average process direction locations of the dash bottoms 122 and the corresponding average process direction locations of the dash bottoms for each of the printed columns 130A-130F in the test pattern 100. The controller 50 identifies the process direction offset for each inkjet that ejects ink drops to form the test pattern as described above.

Process 300 continues as the controller 50 operates one or more of the printheads in the print zone 20 to eject ink drops onto the media web 14 to form a high area coverage test pattern on the media web 14 (block 316). The controller 50 retrieves the high area coverage test pattern data 662 from the memory 52 to control the operation of the printhead 150. The high area coverage test pattern includes printed marks from each of the inkjets in the printhead 150, but the controller 50 operates the printhead 150 with a comparatively large number of inkjets being activated concurrently to produce the test pattern 200. For example, in the simplified embodiment of FIG. 2, the printhead 150 operates groups of one-third of the inkjets simultaneously printed dashes in the test pattern 200 in substantially the same configuration as in the test pattern 100. In the test pattern 200, however, the controller 50 also activates the other inkjets in the printhead to form additional printed marks that are not used directly in the identification of the process direction offsets for each inkjet, but that increase the area coverage of the printed test pattern and increase the level of cross-talk in the printhead 150 because a large number of inkjets in the printhead 150 operate concurrently to form the test pattern 200. The high area coverage test pattern 200 includes gaps between printed marks to enable the controller 50 to identify the process direction locations of the printed marks. In one embodiment, the high area coverage test pattern has a 90% coverage level.

Process 300 continues as the printer 5 generates scanned image data of the high area coverage patter (block 320) and identifies the process direction offset for each of the inkjets that form the printed marks in the high area coverage test pattern (block 324). The controller 50 performs the processing that is described with reference to blocks 320 and 324 in substantially the same manner as described above with regards to blocks 308 and 312, respectively, for the low area coverage test pattern. During processing of the image data for the high-area coverage test pattern 200, the controller 50 ignores a large portion of the printed test pattern 200 when identifying the process direction offset of each inkjet from the scanned image data of the test pattern 200. The printed fiducial marks 140 enable the controller 150 to identify the cross-process direction locations of the marks from each of the inkjets in the printhead 150, and the gaps between the printed dashes, such as the gaps 234A and 234B between dashes in the column 230 for the inkjet 152. The controller 50 identifies the process direction offset for each of the inkjets in the printhead 150 from the printed marks in the high area coverage test pattern 200. While FIG. 3 depicts the identification of the process offset of the inkjets in the printhead for the low area coverage test pattern prior to identification of the process direction offset of the inkjets in the printhead for the high area coverage test pattern, the printer 5 optionally identifies the process direction offset for low and high area coverage test patterns in any order.

Process 300 continues as the controller 50 identifies differences between the identified process direction offset values for each inkjet in the low area coverage test pattern and the high area coverage test pattern (block 328). In one embodiment, the controller 50 subtracts the process direction offset value that is identified for each inkjet in the high area coverage test pattern from the corresponding process offset value in the low coverage are test pattern. The standard deviation of the offset differences are used to characterize the overall level of cross-talk for each printhead, so any order of the subtraction and sign of the difference values can be selected for the process 300.

Figure 5A:
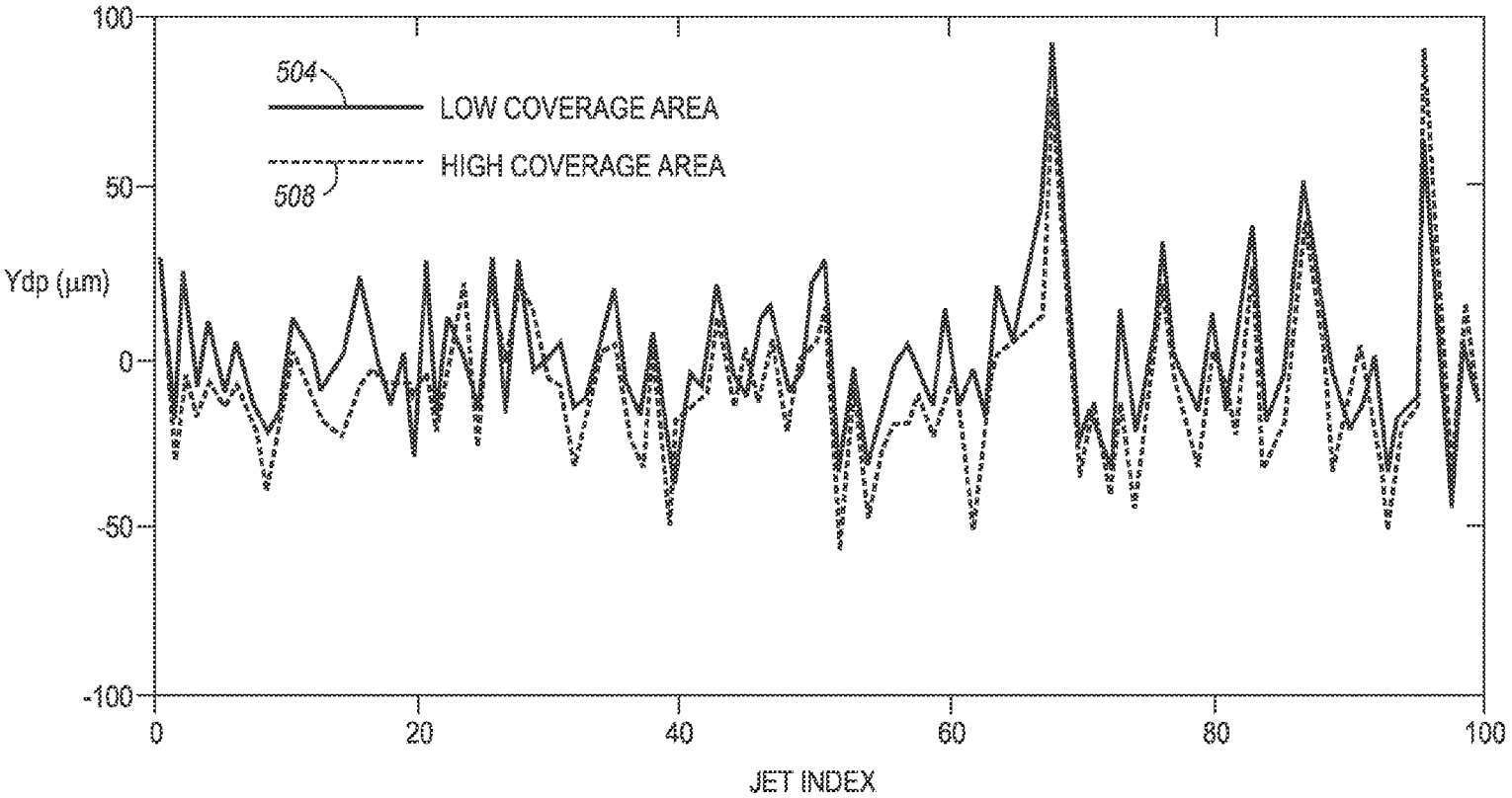
FIG. 5A is a set of graphs depicting process direction drop placement offsets for low area coverage and high area coverage printed test patterns from a single printhead.
Figure 5B:
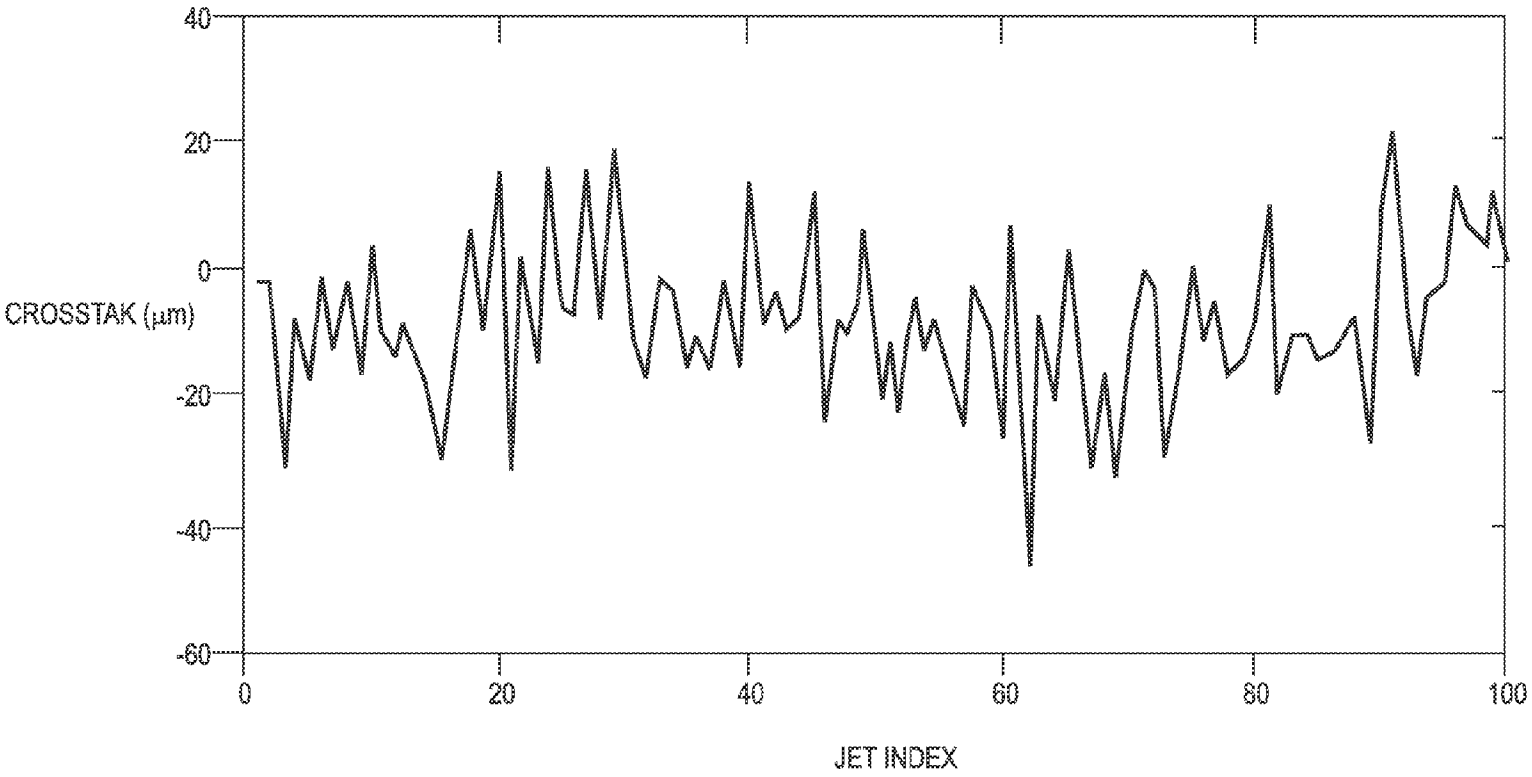
FIG. 5B is a graph depicting the differences between the process direction offsets for the inkjets in a printhead in the graphs of FIG. 5A.

FIG. 5A depicts graphs 504 and 508 that correspond to the process direction offsets for inkjets in a printhead when printing low and high area coverage test patterns, respectively. FIG. 5B depicts a graph of measured differences between the graphs 504 and 508 in FIG. 5A that corresponds to the overall level of cross-talk in the printhead. The graph in FIG. 5A depicts the identified process direction offsets for both the low area coverage test pattern (line 504) and the high area coverage test pattern (line 508) for 100 inkjets in a printhead. The graph in FIG. 5B depicts the differences between the graphs 504 and 508 of FIG. 5A. The controller 50 identifies the standard deviation of the differences between all the inkjets in the printhead to identify an overall level of cross-talk in the printhead. Other metrics that quantify in some way the change in process direction offset between a high area coverage pattern and a low area coverage pattern may also be used.

Process 300 continues as the controller 50 identifies the level of cross-talk in the printhead and generates an output corresponding to a recommended operational configuration for the printhead based on the identified level of cross-talk (block 332). Two examples of operational configuration recommendations based on the identified printhead cross-talk level include ink color selection for the printhead based on the identified cross-talk level and grouping of printheads with similar cross-talk levels together to populate the print zones in different printers.

In one embodiment, the controller 50 generates a recommendation for ink color using one or more predetermined cross-talk thresholds. For example, for printheads that exhibit a small standard deviation between in the process direction offsets between the low and high area coverage test patterns, the controller 50 generates a recommendation that the printhead be used with black ink since black ink printed images tend to exhibit the most noticeable image defects due to cross-talk. For printheads that exhibit an intermediate level of cross-talk, the controller 50 generates a recommendation the use of cyan or magenta ink. For printheads that exhibit the highest level of cross-talk, the controller 50 generates a recommendation for the use of yellow ink since yellow ink exhibits the lowest level of perceptible errors due to cross-talk. The controller 50 stores the recommendations in association with each printhead in the printhead color data 668 or generates a report of the recommended printhead color configuration with the output device 56. If the controller 50 recommends that a printhead should be relocated to another printhead module with a different ink color, an operator reinstalls the printhead during a printer maintenance operation. The process 300 is optionally performed as part of the manufacturing process of the printhead to produce a recommendation for the ink color for the printhead before the printhead is installed in a printer.

In another embodiment, the controller 50 generates an output with the output device 56 that recommends the removal of a printhead from the printer 5 for use with another printer. For example, some printing facilities operate multiple printers that perform print jobs for documents with a range of different print quality levels. The level of print quality that is required some types of print jobs, such as printed advertising circulars, may be lower than the required quality for a full-color magazine or other printed article. The printer 5 is configured to print at a predetermined quality level in the printing facility and the identified level of cross-talk in the printheads are one factor in determining the level of print quality for printed documents that the printer 5 produces. If the identified level of cross-talk for the printhead in the printer 5 exceeds a predetermined threshold that corresponds to the print quality target for the printer 5, then the controller 50 generates an output recommendation that the printhead be removed from the printer 5 for use in another printer that is configured for print jobs that accept a higher level of printhead cross-talk. In another configuration, if the identified level of cross-talk is lower than a predetermined level of cross-talk for the print quality configuration of the printer 5, then the controller 50 optionally generates a message indicating that the printhead could be used in another printer that requires a lower level of printhead cross-talk.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed:

1. A printer comprising:

a printhead including a plurality of inkjets configured to eject ink drops onto an image receiving surface to form an ink image;

an optical scanner configured to generate scanned image data of the ink image on the image receiving surface; and a controller operatively connected to the printhead and the optical scanner, the controller being configured to:

operate the printhead to eject a first plurality of ink drops from the plurality of inkjets to form a first test pattern on the image receiving surface, the first test pattern having a first area coverage;

generate first scanned image data of the first test pattern with the optical scanner;

identify a first plurality of process direction offsets for the plurality of inkjets with reference to the first scanned image data;

operate the printhead to eject a second plurality of ink drops from the plurality of inkjets to form a second test pattern on the image receiving surface, the second test pattern having a second area coverage, the second area coverage being greater than the first area coverage;

generate second scanned image data of the second test pattern with the optical scanner;

identify a second plurality of process direction offsets for the plurality of inkjets with reference to the second scanned image data;

identify a level of cross-talk in the printhead with reference to a difference between the first plurality of process direction offsets and the second plurality of process direction offsets; and store the identified level of cross-talk in a memory in association with the printhead to generate a recommendation for an operational configuration of the printhead during operation of the printer.

2. The printer of claim 1, the controller being further configured to:

operate the printhead to eject the first plurality of ink drops from the plurality of inkjets with a first percentage of the plurality of inkjets being operated concurrently to reduce or eliminate cross-talk during operation of the printhead.

3. The printer of claim 2 wherein the first percentage is 9% of the plurality of inkjets in the printhead.

4. The printer of claim 2, the controller being further configured to:

operate the printhead to eject the second plurality of ink drops from the plurality of inkjets with a second percentage of the plurality of inkjets being operated concurrently, the second percentage being greater than the first percentage, to produce cross-talk during operation of the printhead.

5. The printer of claim 4 wherein the second percentage is 90% of the plurality of inkjets in the printhead.

6. The printer of claim 1 further comprising:

an output device; and the controller being operatively connected to the output device and further configured to:

generate a recommendation for the operational configuration of the printhead indicating an ink color for ejection from the printhead with reference to the identified level of cross-talk in the memory.

7. The printer of claim 6, the controller being further configured to:

generate the recommendation of black ink for ejection from the printhead in response to the identified level of cross-talk being below a predetermined threshold.

8. The printer of claim 6, the controller being further configured to:

generate the recommendation of one of a cyan, magenta, or yellow ink for ejection from the printhead in response to the identified level of cross-talk being above a predetermined threshold.

9. The printer of claim 1 further comprising:

an output device; and the controller being operatively connected to the output device and further configured to:

generate the recommendation that the printhead should be removed from the printer for use in another printer in response to the identified level of cross-talk being above a predetermined threshold.

10. The printer of claim 1, the controller being further configured to:

identify a plurality of differences between the first process direction offset and the second process direction offset identified for each inkjet in the plurality of inkjets in the printhead; and identify the level of cross-talk in the printhead with reference to a standard deviation of the plurality of differences.

11. A method of identifying a cross-talk level in a printhead of an inkjet printer comprising:

operating with a controller a printhead to eject a first plurality of ink drops from a plurality of inkjets in the printhead to form a first test pattern on an image receiving surface, the first test pattern having a first area coverage;

generating with an optical scanner first scanned image data of the first test pattern;

identifying with the controller a first plurality of process direction offsets for the plurality of inkjets with reference to the first scanned image data;

operating with the controller the printhead to eject a second plurality of ink drops from the plurality of inkjets to form a second test pattern on the image receiving surface, the second test pattern having a second area coverage, the second area coverage being greater than the first area coverage;

generating with the optical scanner second scanned image data of the second test pattern with the optical scanner;

identifying with the controller a second plurality of process direction offsets for the plurality of inkjets with reference to the second scanned image data;

identifying with the controller a level of cross-talk in the printhead with reference to a difference between the first plurality of process direction offsets and the second plurality of process direction offsets; and storing with the controller the identified level of cross-talk in a memory in association with the printhead to generate a recommendation for an operational configuration of the printhead during operation of the printer.

12. The method of claim 11 the ejection of the first plurality of ink drops further comprising:

operating with the controller the printhead to eject the first plurality of ink drops from the plurality of inkjets with a first percentage of the plurality of inkjets being operated concurrently to reduce or eliminate cross-talk during operation of the printhead.

13. The method of claim 12 wherein the first percentage is 9% of the plurality of inkjets in the printhead.

14. The method of 12 the ejection of the second plurality of ink drops further comprising:

operating with the controller the printhead to eject the second plurality of ink drops from the plurality of inkjets with a second percentage of the plurality of inkjets being operated concurrently, the second percentage being greater than the first percentage, to produce cross-talk during operation of the printhead.

15. The method of claim 14 wherein the second percentage is 90% of the plurality of inkjets in the printhead.

16. The method of claim 11 further comprising:

generating with the controller and an output device a recommendation for the operational configuration of the printhead indicating an ink color for ejection from the printhead with reference to the identified level of cross-talk in the memory.

17. The method of claim 16 the generation of the recommendation further comprising:

generating with the controller and the output device the recommendation of black ink for ejection from the printhead in response to the identified level of cross-talk being below a predetermined threshold.

18. The method of claim 16, the controller being further configured to:

generating with the controller and the output device the recommendation of one of a cyan, magenta, or yellow ink for ejection from the printhead in response to the identified level of cross-talk being above a predetermined threshold.

19. The method of claim 11 further comprising:

generating with the controller and the output device the recommendation that the printhead should be removed from the printer for use in another printer in response to the identified level of cross-talk being above a predetermined threshold.

20. The method of claim 11 further comprising:

identifying with the controller a plurality of differences between the first process direction offset and the second process direction offset identified for each inkjet in the plurality of inkjets in the printhead; and identifying with the controller the level of cross-talk in the printhead with reference to a standard deviation of the plurality of differences.

* * * * *